United States Patent [19]

Lina

[11] Patent Number: 4,964,547

[45] Date of Patent: Oct. 23, 1990

[54] MANUALLY-OPERATED PRECOMPRESSION TYPE SPRAY HEAD

[75] Inventor: Jean P. Lina, Le Neubourg, France

[73] Assignee: Valois (Societe Anonyme), LePrievre, France

[21] Appl. No.: 242,462

[22] Filed: Sep. 9, 1988

[30] Foreign Application Priority Data

Sep. 9, 1987 [FR] France ..... 87 12496

[51] Int. Cl.[5] ..... B65D 83/14

[52] U.S. Cl. ..... 222/385; 222/402.1; 222/321; 251/347; 251/353; 141/20

[58] Field of Search ..... 222/382–385, 222/402.1, 484, 402.12, 402.16, 402.2, 321, 341; 239/337; 141/3, 30; 251/347, 348, 353, 354

[56] References Cited

U.S. PATENT DOCUMENTS

| | | | |
|---|---|---|---|
| 2,612,293 | 9/1952 | Michel | 222/402.16 |
| 2,802,490 | 8/1957 | Ward | 222/402.16 |
| 3,250,474 | 5/1966 | McKernan | 222/402.12 |
| 3,254,677 | 6/1966 | Wakeman | 222/402.12 |
| 3,651,997 | 3/1972 | Venus, Jr. | 141/20 |
| 4,025,046 | 5/1977 | Boris | 222/321 |
| 4,271,875 | 6/1981 | Meshberg | 222/402.16 |
| 4,317,531 | 3/1982 | Saito et al. | 222/484 |
| 4,503,997 | 3/1985 | Corsette | 222/402.16 |

*Primary Examiner*—Michael S. Huppert
*Assistant Examiner*—Steven Reiss

[57] ABSTRACT

A spray head for use with a receptacle containing a liquid which is maintained under pressure by a propellant gas, thereby enabling a product to be packaged so that it is protected from coming into contact with the air, the spray head being of the type comprising a manually-operated precompression pump which includes a pump chamber comprising first and second cylinders (11, 15) capable of engaging telescopically, said chamber being closed by relative displacement of said cylinders, said first cylinder being integral with the pump outlet valve and being provided at one of its end with a circular sealing lip (12) capable of engaging against and of sliding along the wall of said second cylinder, which second cylinder is in communication with the inside of the receptacle, said wall being provided at at least one of its ends with fairly substantial relief (18, 25) such that when said sealing lip lies over said relief and said relief causes sealing to be broken, a passage is opened suitable for passing gas at a rate of flow which is sufficient for filling the receptacle.

4 Claims, 4 Drawing Sheets

MANUALLY-OPERATED PRECOMPRESSION TYPE SPRAY HEAD

The invention relates to a spray head device of the manually-operated precompression type and usable for atomizing a liquid contained in a receptacle.

The invention relates more particularly to a spray head for use with a receptacle containing a liquid which is maintained under pressure by a propellant gas for the purpose of protecting the liquid content from coming into contact with the air and also for the purpose of facilitating priming of the pump and of ensuring that the pump chamber is filled more quickly and more completely. The propellant gas (e.g. freon) may be dissolved in the liquid, or else it need not be dissolved (e.g. nitrogen).

BACKGROUND OF THE INVENTION

A suitable prior art pump includes a pump chamber comprising first and second telescopically-slidable cylinders with the pump chamber being capable of being closed by relative displacement of the cylinders. The first cylinder is integral with the pump outlet valve and is provided at one of its ends with a circular sealing lip capable of engaging against and of sliding along the wall of the second cylinder, which second cylinder is in communication with the inside of the receptacle. When the facing edges of the two cylinders at a distance are apart from each other, the gap between the two edges allows communication to take place between the pump chamber and the inside of the receptacle. When one of the cylinders is engaged inside the other, this communication is interrupted and the pump chamber is isolated, thus providing a pump chamber which is annular in shape and which surrounds said two cylinders. Such pumps are described, for example, in French patents numbers 2 305 241 and 2 341 772 and in the corresponding U.S. Pat. No. 4,025,046. The pumps described in these patents are used without a propellant gas. They could naturally also be used with a propellant gas by ensuring that there is no communication with the outside atmosphere, i.e. that the volume of liquid expelled by the pump is not replaced by a volume of air. However, this raises the problem of inserting the propellant gas into the receptacle after the receptacle has been filled with liquid and the pump has been put into place and crimped onto the receptacle.

An object of the present invention is to make it possible to fill the volume left empty in the receptacle with the peopellant gas in a manner which is simple and reliable.

French patent number 2 407 752 describes a precompression pump atomizing a liquid, but in which no provision is made for receiving a gas under pressure in order to prevent the entry of air to replace the volume of liquid that is ejected. In this prior pump, as in the other pumps mentioned above, the outlet valve opens only when the pressure in the chamber reaches a certain value. When the pump is primed, the chamber is filled with liquid. If the volume of the chamber is reduced, then the pressure rises to a high value very quickly since the liquid is incompressible, so the valve member lifts and the liquid is expelled. However, when the pump is first used, its chamber is filled with air so reducing the volume of the chamber raises the gas pressure relatively little and the valve member does not lift. The air stagnates in the chamber and initial pump primimg is made difficult. The pump described in said patent includes means for facilitating such priming, or even for making priming possible. To this end, the second cylinder is provided with notches or projections for putting the volume of the pump chamber into communication with the inside of the receptacle when the pump is actuated to its fullest extent. Passages are thus disengaged level with the sealing lip. The cross-section of these passages is very small. They serve solely for evacuating the volume of air from the chamber. The pump position required for obtaining such evacuation must necessarily be obtained by normal manual actuation of the pump.

The present invention relates to means making it possible to insert gas into the receptacle after it has been filled with liquid, with the quantity of gas inserted being sufficient to prevent any air from entering the receptacle until all of the liquid has been expelled therefrom.

SUMMARY OF THE INVENTION

According to the present invention, the second cylinder which is in communication with the inside of the receptacle includes, at at least one of its ends, relief of sufficient size to enable a high flow rate to pass easily when the sealing lip of the first cylinder is level with said relief.

In a particular embodiment, the relief is constituted by grooves or notches formed on the edge of the second cylinder at its end furthest from the receptacle, i.e. at its end closest to the pump outlet valve, and these notches are long enough to provide a good passage for the filling gas when the sealing lip of the first cylinder lies over them, i.e. when the pump valve member is pushed back for filling purposes sufficiently to allow the filling gas to enter, with the notches then still extending substantially beyond the sealing lip of the first cylinder even though the lip is displaced simutaneously with the valve member since it is constrained to move therewith.

In a second embodiment, the relief is formed on the end of the second cylinder which is situated adjacent to the receptacle, i.e. at its end which is furthest from the pump valve.

Advantageously, the relief is formed by at least one projecting rib with the rib projecting far enough to prevent the sealing lip of the first cylinder from passing onto the rib undre mere manual pressure. In order to move the lip onto the rib, thrust must be provided by a filling machine. In this case, normal operation of the pump will not be interfered with by the sealing of the lip being broken.

In either case, it is advantageous for the valve member to be designed so as to be capable of being pushed back by a needle so as to cause the valve to be opened by a filling machine. Instead of being terminated by a point as is conventional, the valve member may therefore include a central needle-receiving flat or small dent at its end. The sealing action of the valve member takes place on a conical portion of its surface surrounding the dent. The needle is pushed in until the sealing lip of the first cylinder comes level with the relief of the second cylinder. The propellant gas can then be inserted into the receptacle. Depending on which end of the second cylinder has the relief, the relative positon of the two cylinders applicable to filling will correspond either to the beginning of the pump stroke or else to the end of its stroke.

When the relief on the second cylinder is placed so that the seal is broken at the beginning of the stroke, the spray head may be simpler to realize, but closure of the pump chamber during ordinary use is delayed, i.e. pump capacity is reduced.

BRIEF DESCRIPTION OF THE DRAWINGS

Embodiments of the invention are described by way of example with reference to the accompanying drawings, in which.

DETAILED DESCRIPTION

Figure 1:
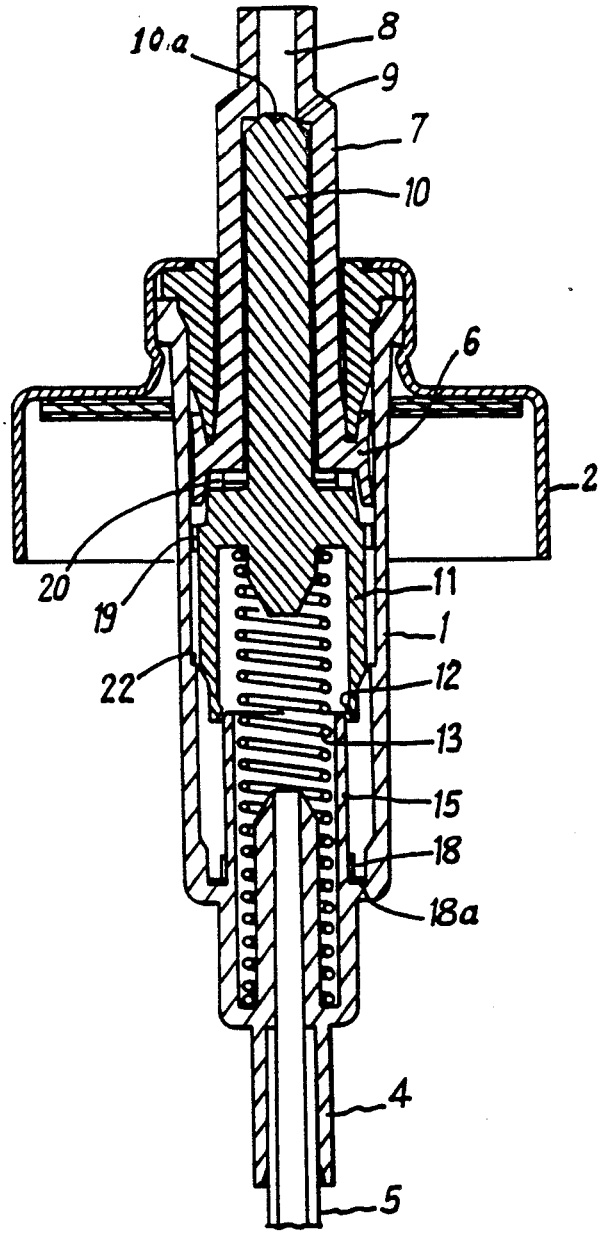
FIG. 1 is an axial section through a precompression pump constituting a first embodiment of the invention and shown in its rest state.

The pump shown in axial section in the figures operates in well-known manner except, with respect to the modification of the present invention. The pump is provided for being received in the opening of a receptacle. It comprises a pump body 1 whose top end is crimped in a capsule 2 which is provided for the purpose of being crimped in turn to the neck of a receptacle (not shown) together with appropriate interposed sealing rings. The bottom portion presents a collar 4 in which or on which a dip tube 5 is engaged. A piston 6 is free to slide inside the pump body and is integral with a rod 7 which projects outside the pump. An ejection channel 8 passes through the rod and the piston. A pushbutton is provided for fitting onto the top end of the rod 7 in order to push down the rod together with the piston. A valve seat 9 is formed in conventional manner in the channel 8 and the seat is engaged with a valve member constituted by a pin 10 which is integral with a first cylinder 11 having a sealing lip 12 at its bottom end. The valve member is urged upwardly into its closure position by a spring 13 which bears downwardly against the bottom of the pump body. The first cylinder is designed to be capable of moving downwardly around a second cylinder 15 which is fixed to the bottom of the pump body. In the rest state, the valve member is urged upwardly by the spring 13 and drives the piston upwardly until it reaches its abutment position, with the valve being kept closed. In the rest position (as ahown in FIG. 1), the first and second cylinders are separate from each other. There is an annular passage between them enabling the chamber to be filled both by suction and under the effect of a propellant gas. When the piston is pressed down, the sealing lip 12 engages around the second cylinder 15, thereby closing the annular passage and defining an annular pump chamber between the pump body 1 and the first and the second cylinders 11 and 15. As the piston continues to move downwardly, the volume of the pump chamber is reduced, thereby compressing the product contained therein until the pressure is sufficient to be in equilibrium with the spring 13 and then to counterbalance it, thereby causing the valve member 10 to move down together with the cylinder 11 whose lip 12 is sliding along the second cylinder 15. The product can then escape via the channel 8 so long as the pressure in the chamber remains greater than the pressure due to the action of the spring 13. The above description is conventional and the pump as described constitutes one of the embodiments shown in the above-mentioned patents. The present invention is applicable to all of the embodiments described therein.

Figure 2:
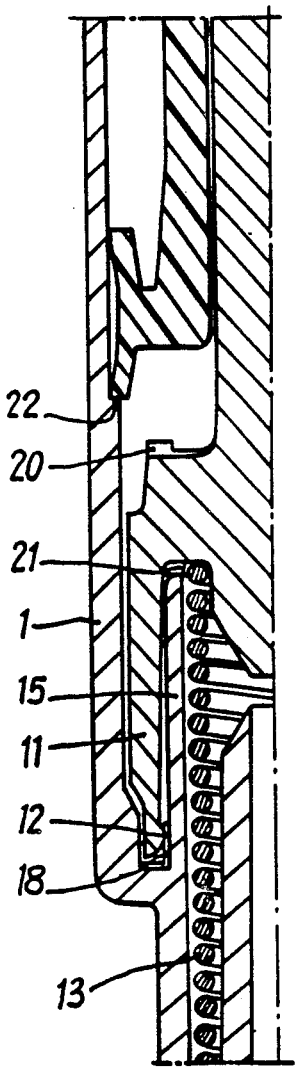
FIG. 2 is a fragmentary section showing the FIG. 1 pump in its filling position.

In one embodiment of the present invention as shown in FIGS. 1 and 2, relief constituted by ribs 18 is formed around the bottom of the second cylinder 15 at the bottom of the pump chamber. So long as the sealing lip 12 engages the outside surface of the second cylinder 15 above the ribs 18 it provides sealing and the pump chamber is closed so that the liquid contained therein can only escape by unseating the pin. However, if the valve body is moved down, e.g. by means of a needle 31 (FIG. 3), until the sealing lip engages the ribs 18 (see FIG. 2) then sealing is no longer provided. If, in this position, the valve member is lifted off its seat on the piston, it is then possible to inject a gas under pressure into the receptacle via the injection channel 8. In order to facilitate this operation, the central portion of the pin is formed with a small dent **10*a* which automatically centers the needle 31** and prevents it from being deflected sideways. Although it is preferable to provide a dent, a small flat would suffice.

Instead of providing ribs 18 in relief, it is also possible to provide hollow grooves. Ribs have an advantage: they provide a thickening which serves to stop the valve member from moving downwardly under the effect of manual pressure which is not generally sufficient to force the lip 12 over the thickening by spreading out the lip. It is then not possible for a user to accidentally break the seal at the end of a down stroke, i.e. after expelling a quantity of product. In contrast, the machine for filling the can with propellant gas may be provided with means capable of elastically spreading the sealing lip around the ribs 18.

In order to ensure that the pump operates properly under all circumstances, both while being filled with propellant gas and during normal operation, it is possible to provide means for preventing the substance-passing passages from being blocked in untimely manner. Thus, in order to prevent the passage being blocked by the bottom edge of the first cylinder 11 pressing against the bottom of the pump chamber when the first cylinder is pushed down fully, the ribs 18 are provided with 90° extensions **18*a* in the bottom of the chamber. In order to guide the valve member against the inside wall of the pump body without blocking the passage, the valve member is advantageously provided with guide ribs 19**.

In order to ensure that there is always a free passage between the pin and the inside, it is also possible to provide ribs 20 on the top of the widened portion of the valve member between the first cylinder 11 and the rod of the pin (see also FIG. 2). Finnally, ribs 21 are provided at the bottom of the first cylinder 11 in order to prevent the passage from being blocked by the top edge of the second cylinder when the first cylinder is pushed down fully (see also FIG. 2).

In normal use, the user may be prevented from moving the valve member to its extreme bottom position where the sealing lip 12 is level with the ribs 18 (e.g. by virtue if the user pressing too hard on the pushbutton, or in the event of the relief being constituted by hollowed-out ribs), it is possible to provide means for limiting the stroke of the piston. In the embodiments shown in FIGS. 1 and 2, a step 22 is provided on the inside wall of the pump body: this positively limits the piston down stroke and consequently the down stroke of the valve member at a desired height. It may be observed that in FIG. 2 the valve member is shown in its lowest position with the spring being fully compressed.

Figure 4:
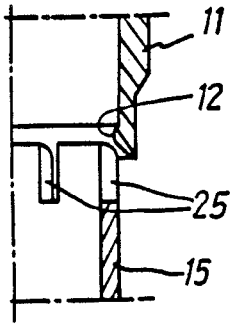
FIG. 4 is a detailed view of a variant of the FIG. 3 embodiment.
Figure 3:
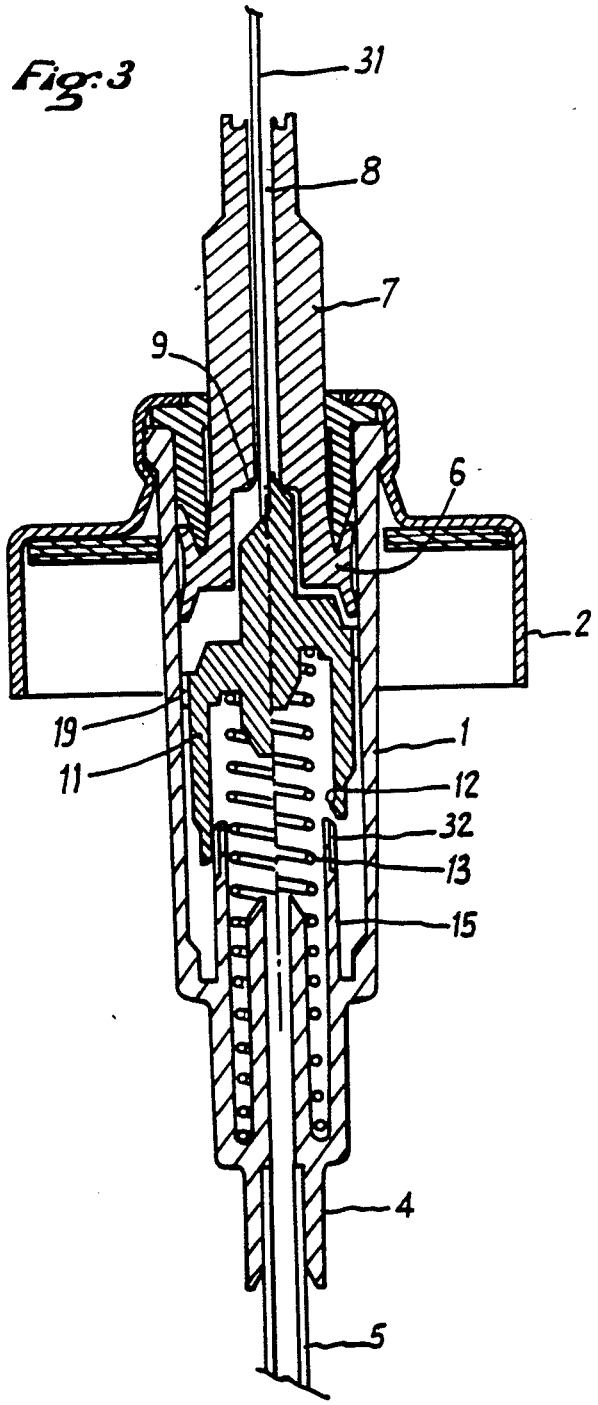
FIG. 3 is a split axial section through a second embodiment of the invention, with the righthand side of the figure showing the pump in its rest state and the lefthand side of the figure showing the pump during propellant gas filling.

In the embodiment shown in FIG. 3, the relief on the second cylinder 15 is formed on that end of this cylinder which, in the rest position (righthand side of the figure), is the closest to the first cylinder. In FIG. 3, the relief is constituted by grooves 32. It could also be formed by cut-outs 25 (see detailed view of FIG. 4). These grooves or cut-outs should be of sufficient cross-section to allow a high gas flow rate.

In order to fill a can with propellant gas, a needle 31 (see lefthand half of FIG. 3) is used to lower the valve member so as to bring the sealing lip 12 halfway along the grooves 32, thereby clearly lifting the pin of its seat 9, but without lowering the piston which is maintained in its uppermost position. The passage is then opened. The grooves or cut-outs must delimit a cross-section which is large enough to pass a filling rate of gas flow. In order to fill the receptacle with gas, the valve must be opened and the valve member 10 must be lowered by about one millimeter. For the gas to flow adequately, the grooves must extend beneath the sealing lip which will have moved down by 1 mm from its rest position. Given the gap which exists in the rest position between the ends of the cylinders, it is necessary for the grooves to be 1.5 mm long in practice, and this is independent of the dimensions and the volume of the pump. This 1.5 mm criterion is thus intrinsically applicable regardless of the stroke of the pump which is normally 7 mm but which may be 5 mm or 10 mm. It is a function of the gap which exists at rest between the facing ends of the cylinders and of the thickness of the sealing lip. Thus, for pump housings of sizes which are conventional in perfumery, pharmacy, etc., it appears that the groove length must not be less than 1.5 mm. This embodiment which is simpler to manufacture nevertheless suffers from the drawback of reducing the effective stroke of the pump by a distance equal to the effective height of the grooves 32 or cut-outs 25. In a variant, it would also be possible to provide outwardly projecting ribs. However, this would give rise to resistance that would need to be overcome at the beginning of the piston in normal use.

Figure 5:
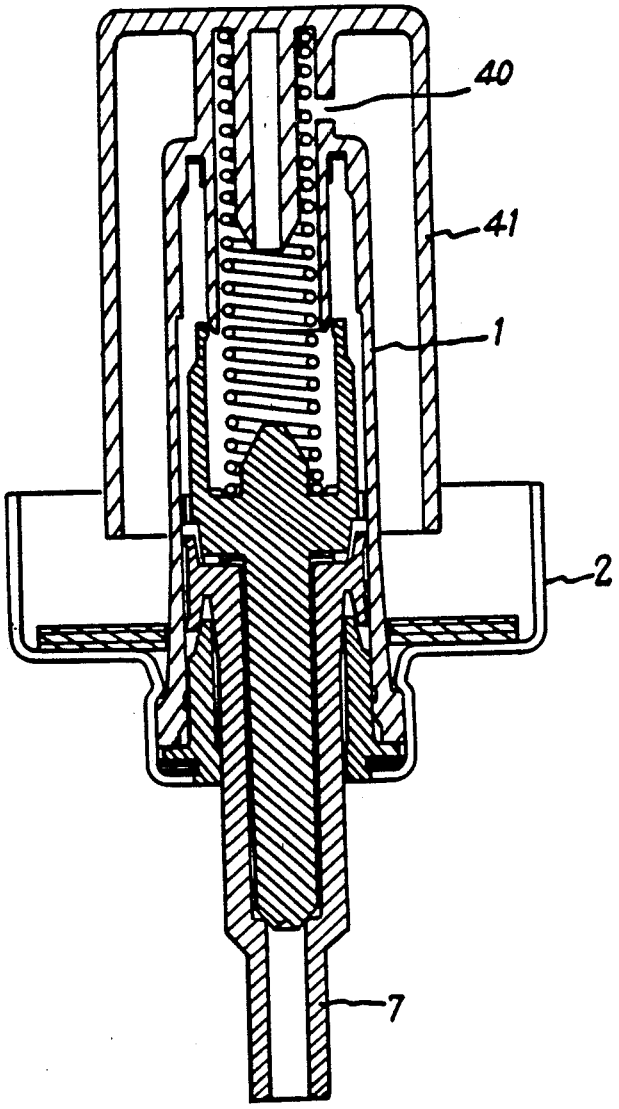
FIG. 5 is a section view through a pump in accordance with the invention and designed for use on the upsidedown position.

A pump in accordance with the invention may be designed for use in the upsidedown position (FIG. 5). In this application, the liquid product enters the pump body via a side hole 40 situated above the pump chamber, and the bottom of the pump body is closed. In particular, there is no collar for connecting a dip tube. In order to use as much product as possible, i.e. in order to recover the quantity of product situated beneath the level of the hole 40 when the pump (and the receptacle in which it is mounted) is in the upsidedown position, the body of the pump is provided with an upwardly directed cup 41 (which is downwardly directed when in the upsidedown position) extending to the vicinity of the capsule 2.

We claim:

1. A spray head for use with a receptacle containing a liquid which is maintained under pressure by a propellant gas, thereby enabling a product to be packaged so that it is protected from coming into contact with the air, said spray head being of the type comprising a manually-operated precompression pump which includes a pump chamber comprising first and second cylinders capable of engaging telescopically, said chamber being closed by relative displacement of said cylinders, said first cylinder being integral with a pump outlet valve and being provided at one of its ends with a circular sealing lip capable of engaging against and of sliding along the wall of said second cylinder, which second cylinder is in communication with the inside of said receptacle, said wall being provided with a relief constituted by grooves or notches formed on that end of said second cylinder which is furthest from said receptacle, said notches having a length of not less than 1.5 mm, so that when said sealing lip lies over said relief, said relief causes sealing to be broken, opening a passage suitable for passing said propellant gas at a rate of flow which is sufficient for filling said receptacle.

2. A spray head according to claim 1, further including a pump piston and means for limiting the stroke of said pump piston, said pump piston being integral with a hollow rod and an internal valve seat for said pump outlet valve, said means for limiting the pump piston stroke being such that when said pump is normally actuated, said projecting rib always remains outside said first cylinder.

3. A spray head according to claim 2, further including a pump body, wherein said means for limiting the stroke of said pump piston are constituted by a peripheral step in the inside wall of said pump body.

4. A spray head according to claim 1, wherein the end of said pump outlet valve has a flat or dent formed in the middle thereof.

* * * * *